US005685370A

United States Patent [19]

Smith, Jr. et al.

[11] Patent Number: 5,685,370

[45] Date of Patent: Nov. 11, 1997

[54] DUAL-BORE, ANTIROTATING PUMP ASSEMBLY

[75] Inventors: Sidney K. Smith, Jr., Conroe, Tex.; Olav Revheim, Randaberg, Norway

[73] Assignee: Baker Hughes Incorporated, Houston, Tex.

[21] Appl. No.: 551,242

[22] Filed: Oct. 31, 1995

[51] Int. Cl.[6] ..... E21B 23/02

[52] U.S. Cl. ..... 166/214; 166/217

[58] Field of Search ..... 166/210, 214, 166/216, 217, 126, 136, 138

[56] References Cited

U.S. PATENT DOCUMENTS

| | | | |
|---|---|---|---|
| 3,065,792 | 11/1962 | Andrew . | |
| 4,363,359 | 12/1982 | Taylor et al. | 166/214 |
| 4,749,341 | 6/1988 | Bayh, III | 166/214 X |
| 4,896,721 | 1/1990 | Welch | 166/214 |
| 4,913,239 | 4/1990 | Bayh, III . | |
| 5,094,294 | 3/1992 | Bayh, III . | |

FOREIGN PATENT DOCUMENTS

| | | |
|---|---|---|
| 2285463 | 7/1995 | United Kingdom . |

*Primary Examiner*—William P. Neuder
*Attorney, Agent, or Firm*—Rosenblatt & Redano P.C.

[57] ABSTRACT

An assembly for a production string with a downhole pump is disclosed which makes use of the polished bore in the top of the liner already installed in the wellbore. Lugs on the assembly align themselves with longitudinal grooves in the top of the liner assembly as an antirotation feature for when the downhole pump is operated. A signaling assembly, involving a collet which can be ultimately released, gives the surface personnel the feedback they need to know that the assembly has been set in the proper place in the top of the liner string, as opposed to another location in the wellbore. Seals, preferably stacks of opposed chevron seals, can be used to bridge the gap between the assembly and the seal bore at the top of the liner.

17 Claims, 10 Drawing Sheets

DUAL-BORE, ANTIROTATING PUMP ASSEMBLY

FIELD OF THE INVENTION

The field of this invention relates to production string assemblies in combination with downhole pumps and methods for securing and sealing them in a wellbore.

BACKGROUND OF THE INVENTION

In the past, after casing is run in a wellbore and cemented, a liner assembly is then installed and secured to the casing with known liner hangers. At the upper end of the liner assembly, which is secured to the casing, is generally a sleeve having a polished bore. This sleeve is generally employed in setting of the liner hanger against the casing.

In prior installations, sump packers have been used in combination with a production string having a downhole pump at its lower end. The pump is powered by an electric line run parallel to the production string in the annulus of the wellbore. The sump packers have generally been dual-bore, retrievable-resettable, and are fairly complicated and generally expensive. Use of such packers, apart from adding expense to the operation, also added certain operational uncertainties generally relating to the reliability of the packers to remain in position, as well as potential difficulties in trying to retrieve the production string with the sump packer at its lower end.

Accordingly, the present invention has been developed to address a more economical and reliable way to secure in a sealing manner the production tubing with respect to the liner. To accomplish this, the assembly makes use of the polished bore at the top of the liner assembly for sealing therewith. The assembly has provisions for resisting torque reaction from the downhole pump when secured in a sealing manner to the top of the liner. Additionally and optionally, a signalling feature can be added to the invention to allow surface personnel to determine that the apparatus has been correctly positioned for the start of production.

It is another object of the invention to provide a low-cost, reliable, readily resettable assembly that can withstand substantial differential pressures, while at the same time be relatively easy to install and remove.

SUMMARY OF THE INVENTION

An assembly for a production string with a downhole pump is disclosed which makes use of the polished bore in the top of the liner already installed in the wellbore. Lugs on the assembly align themselves with longitudinal grooves in the top of the liner assembly as an antirotation feature for when the downhole pump is operated. A signaling assembly, involving a collet which can be ultimately released, gives the surface personnel the feedback they need to know that the assembly has been set in the proper place in the top of the liner string, as opposed to another location in the wellbore. Seals, preferably stacks of opposed chevron seals, can be used to bridge the gap between the assembly and the seal bore at the top of the liner.

DETAILED DESCRIPTION OF THE PREFERRED EMBODIMENT

Figure 1A:
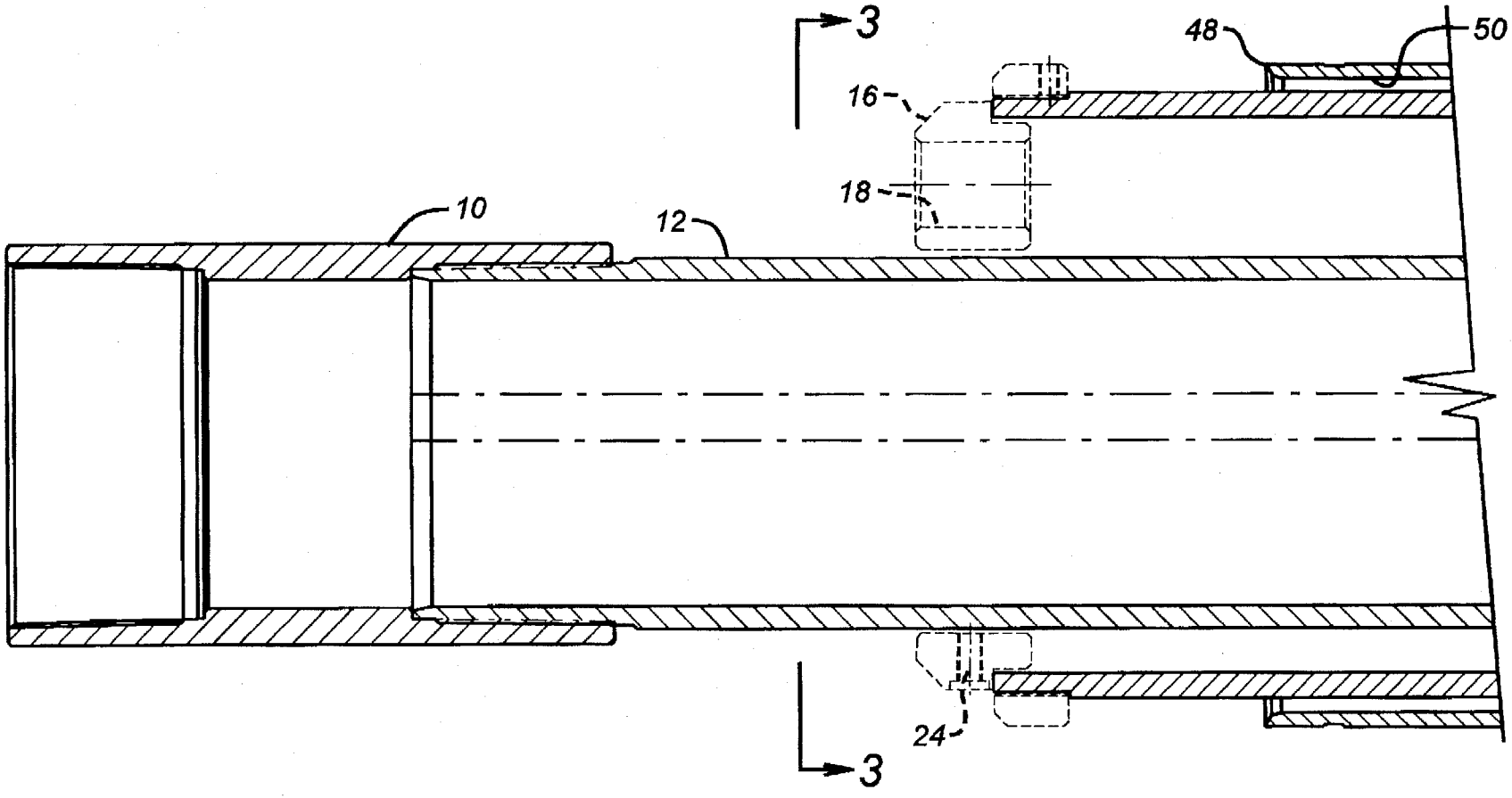
FIGS. 1*a–c* are a sectional elevational view illustrating the preferred embodiment of the apparatus of the present invention with the downhole pump illustrated schematically.

Referring to FIG. 1*a*, a collar 10 represents a portion of the production string, the rest of which is not shown. Below the collar 10 is discharge line 12 for pump P. In FIG. 1*c*, the pump P is shown schematically and is, in the preferred embodiment, a known submersible pump which is electrically operated through an electric line. Attached to the discharge line 12 is a locator L which has extending through it a longitudinal passage 14, which can also be seen through FIG. 2. At the top of the discharge line 12 is a top cap 16, which is also attached to the discharge line 12. Top cap 16 has a longitudinal passage 18, which is aligned with longitudinal passage 14. FIG. 3 illustrates the alignment of the longitudinal passages 14 and 18 when that figure is compared to FIG. 2. The electric line (not shown) extends through the longitudinal passages 14 and 18 down to the pump P.

Figure 2:
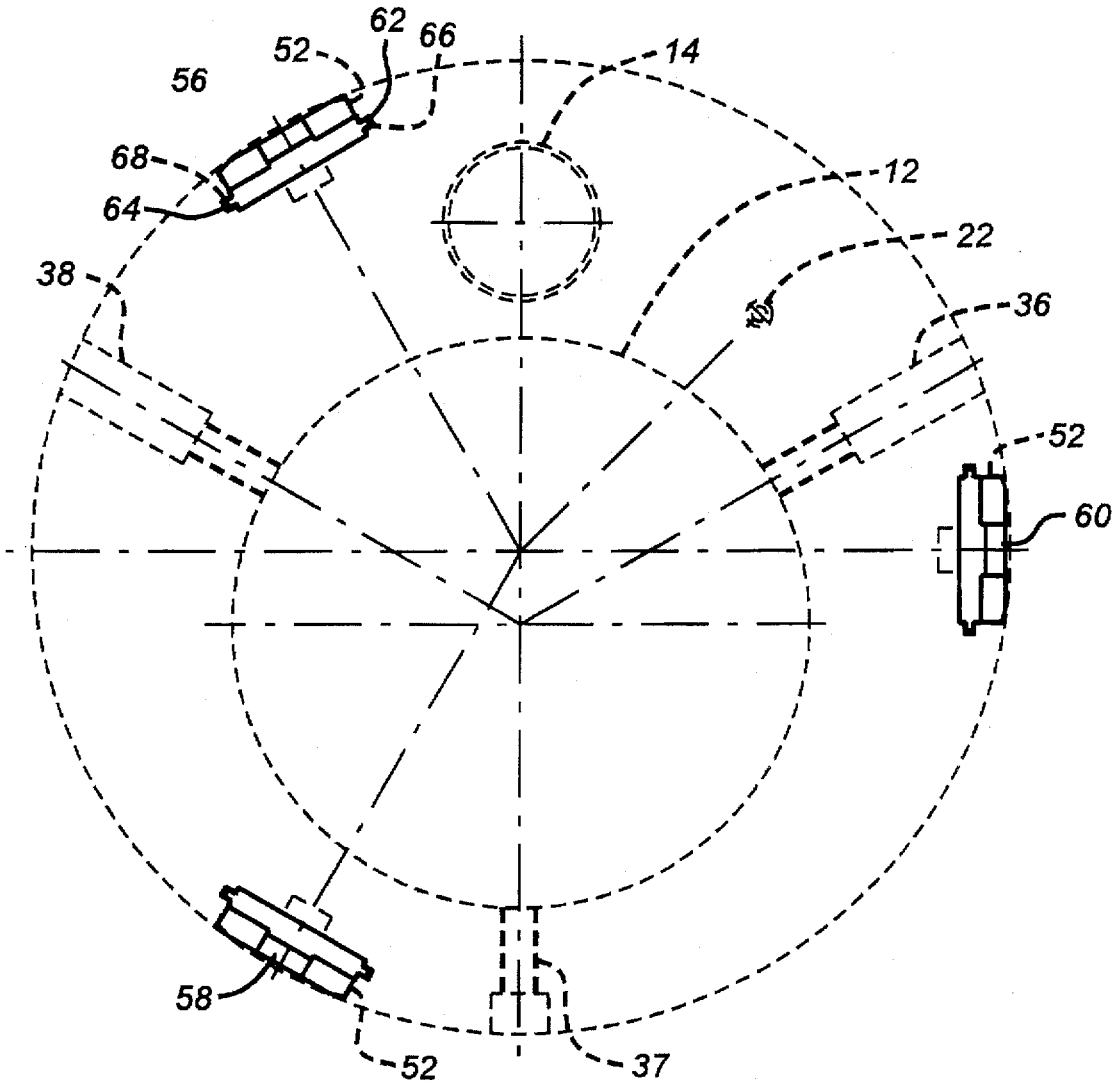
FIG. 2 is a view taken along lines 2—2 of FIG. 1.
Figure 3:
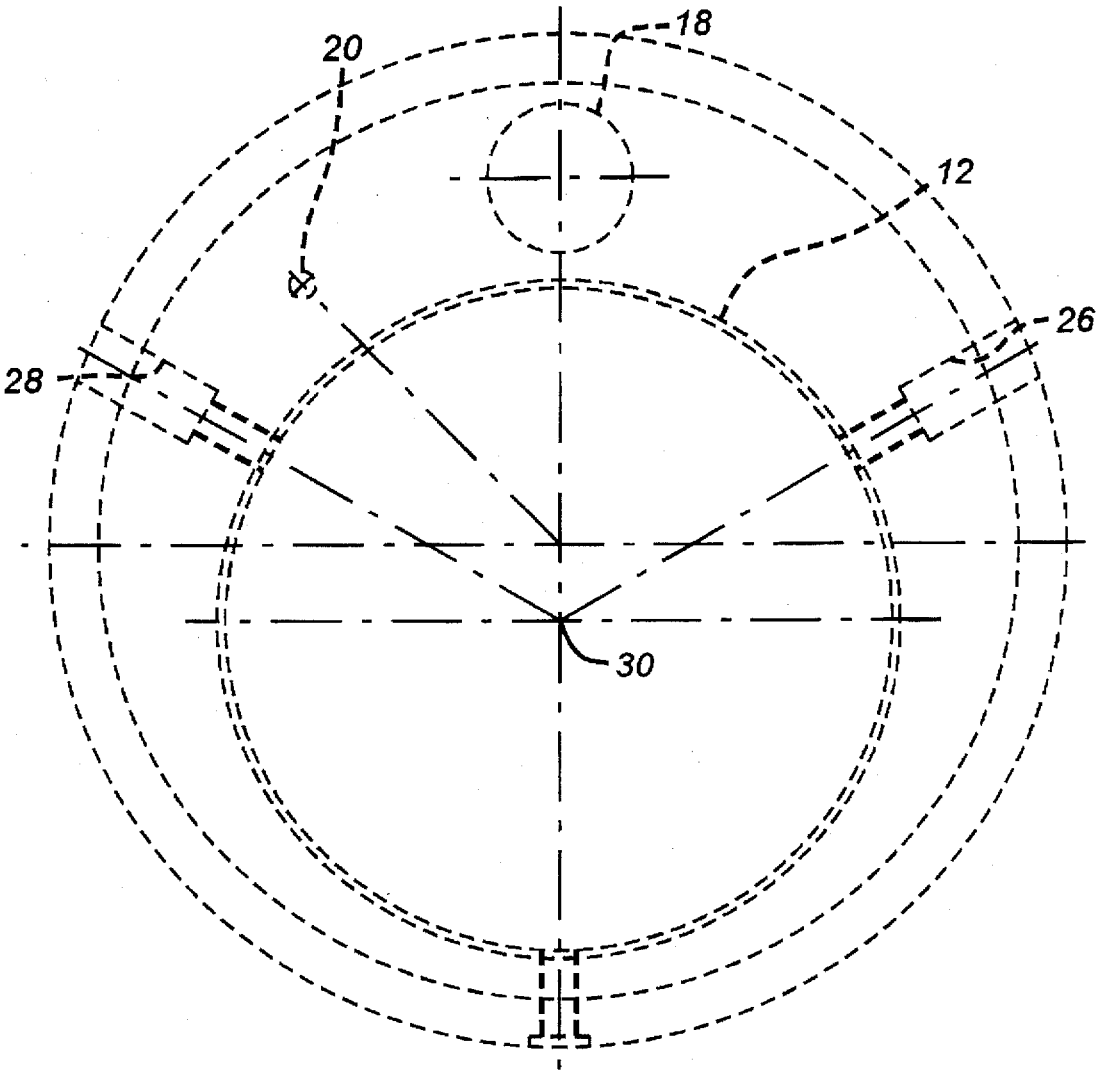
FIG. 3 is the view taken along lines 3–3 of FIG. 1.

As shown in FIGS. 2 and 3, the top cap 16 has an injection bore 20 extending therethrough. The injection bore 20 is not visible in the section view of FIG. 1*a* because it is circumferentially displaced from the longitudinal passage 18, as shown in FIG. 3. Aligned with bore 20 is a threaded bore 22 in locator L. An injection line (not shown) is run through bore 20 and is threadedly engaged to bore 22 to inject into the formation below locator L. Bore 22 is aligned with the injection bore 20, as seen by comparing FIGS. 3 and 2. A pin or pins 24 extend through the top cap 16 into contact with discharge line 12. The pin or pins 24 extend through bores 26 and 28, as shown in the section view of FIG. 3. The bores 26 and 28 are oriented to be in alignment with the center longitudinal axis 30 of the discharge line 12. Accordingly, the pin or pins 24 secure the top cap 16 to the discharge line 12.

Figure 1B:
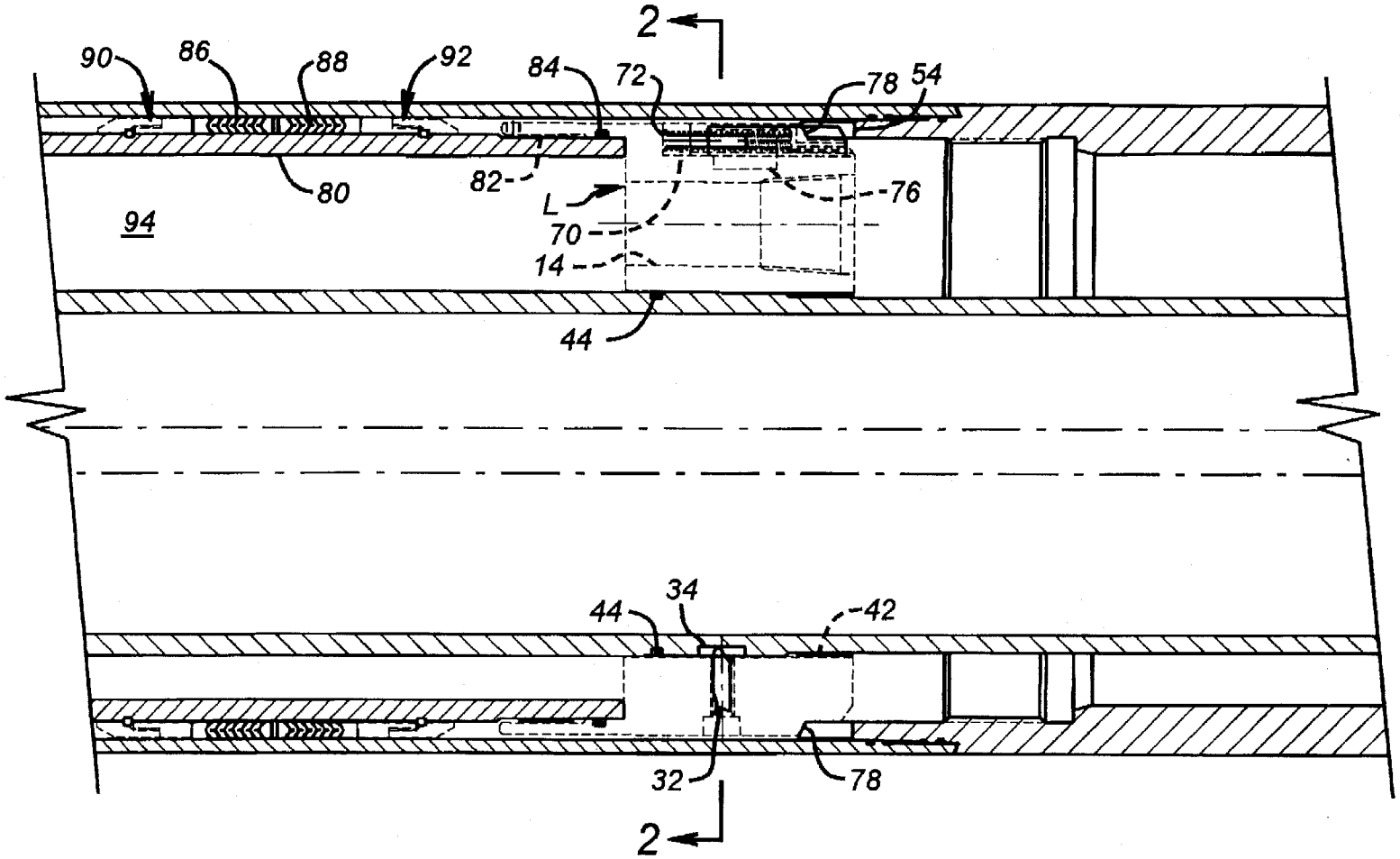
Figure 1C:
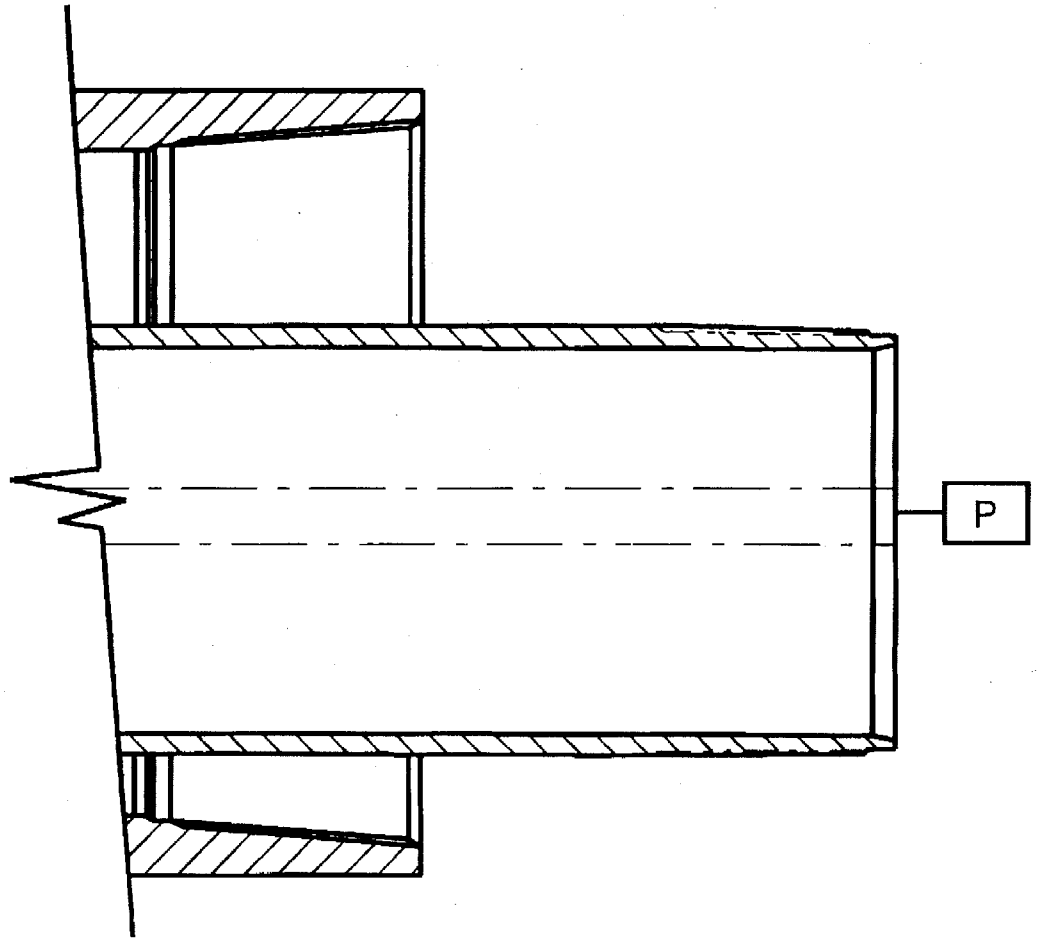

The locator L is secured to the discharge line 12 by virtue of pin or pins 32, which extend into a respective recess 34 in discharge line 12, as shown in FIG. 1*b*. Pin or pins 32 extend through bores such as 36, 37 and 38, as shown in the section view of FIG. 2. Bores 36, 37 and 38 are aligned with the center 40 of discharge line 12. A threaded connection 42 sealed by seal 44 further secures the locator L to the discharge line 12. In essence, the extension of pins 32 into grooves 34 provides a rotational lock between the discharge line 12 and the locator L. Ultimately, as will be described below, the locator L is rotationally locked to the liner 46 so that upon starting the pump P, the torque reaction created by the pump P is resisted by the entire assembly which is rotationally locked to the liner 46, which has by then been cemented or otherwise secured within the wellbore.

The liner 46 has a top end 48. Inside is a polished bore 50, at the bottom of which are a series of longitudinal slots 52. Each of these longitudinal slots, better shown in FIG. 2, has a bottom 54. The locator L features, in the preferred embodiment, three spring-loaded torque fingers 56, 58, and 60. In the preferred embodiment, the torque fingers 56, 58, and 60 are equally distributed at 120°, as shown in FIG. 2. Each of the torque fingers, such as 56, has a pair of opposed guide lugs 62 and 64, which extend into matching grooves 66 and 68, respectively. The guide grooves 66 and 68 are formed into the body of the locator L. As shown in FIG. 1*b*, each of the torque fingers 56–60 has a spring or springs 70 guided by guide 72. In order to retain the torque fingers 56–60 to the locator body in a manner so as to limit their range of longitudinal movement, a pin 74, better seen in FIG. 4, extends transversely through a torque finger, such as 56, and into a longitudinal groove 76 (see FIG. 4). The longitudinal slots 52 present therebetween a series of stop shoulders 78, which are ultimately contacted by the locator L when the torque fingers 56–60 descend into the slots 52 toward their bottom 54.

Also secured to locator L is a sleeve 80, connected to locator L by thread 82, which is sealed off by seal 84. In the preferred embodiment, opposed chevron seals 86 and 88 are held between retaining rings 90 and 92 on the outside of sleeve 80. As shown in FIG. 1*b*, the stacks of chevron seals 86 and 88 make contact with the polished bore 50 to effectively seal off the annulus in the wellbore. The electric line (not shown) passes through longitudinal passages 14 and 18. The injection inlet line extends through bore 20 (see FIG. 3) and into flow communication the injection outlet 22 after passing through annular space 94 (see FIG. 2).

When the assembly is fully put together as shown in FIGS. 1*a–c*, the stacks of chevron seals 86 and 88 are retained longitudinally by retaining rings 90 and 92 and are in sealing contact with the seal bore 50. Those seals, in combination with O-ring 44, effectively seal off the annulus in the wellbore.

Figure 4:
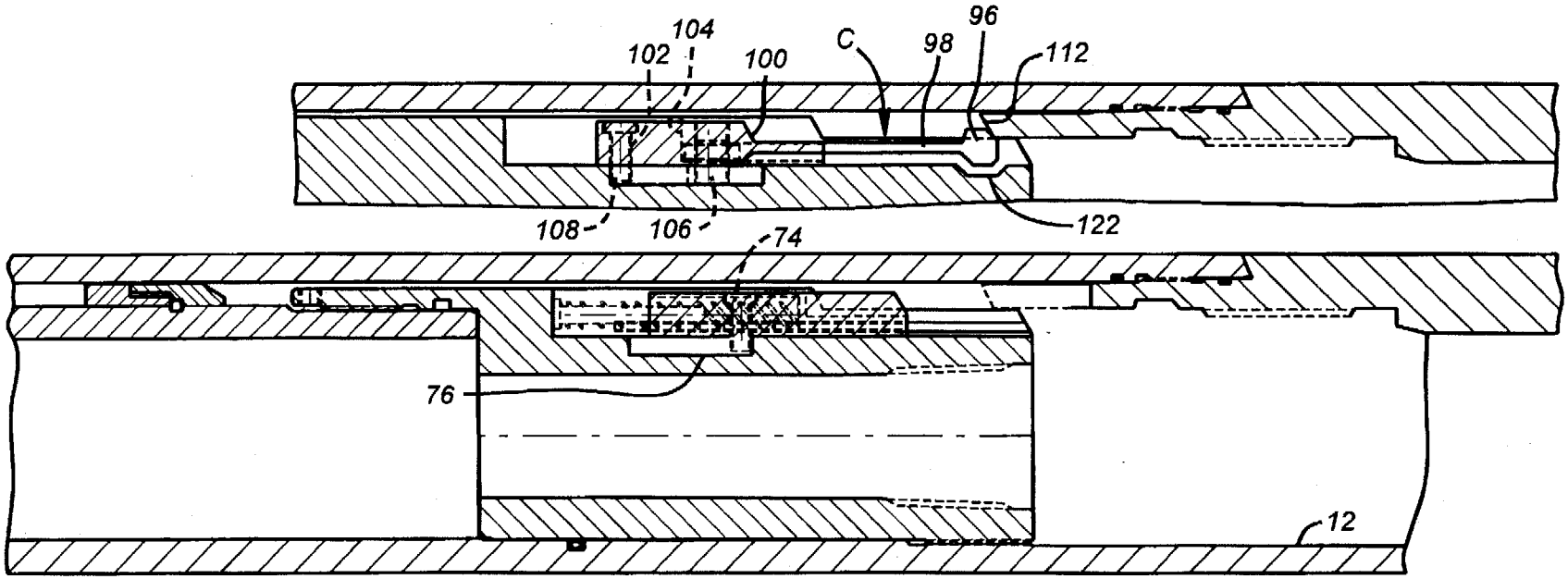
FIG. 4 is a sectional elevational split view of an alternative embodiment, showing the rotationally offset collet latching feature in the location position immediately above the rotational lock feature.
Figure 6:
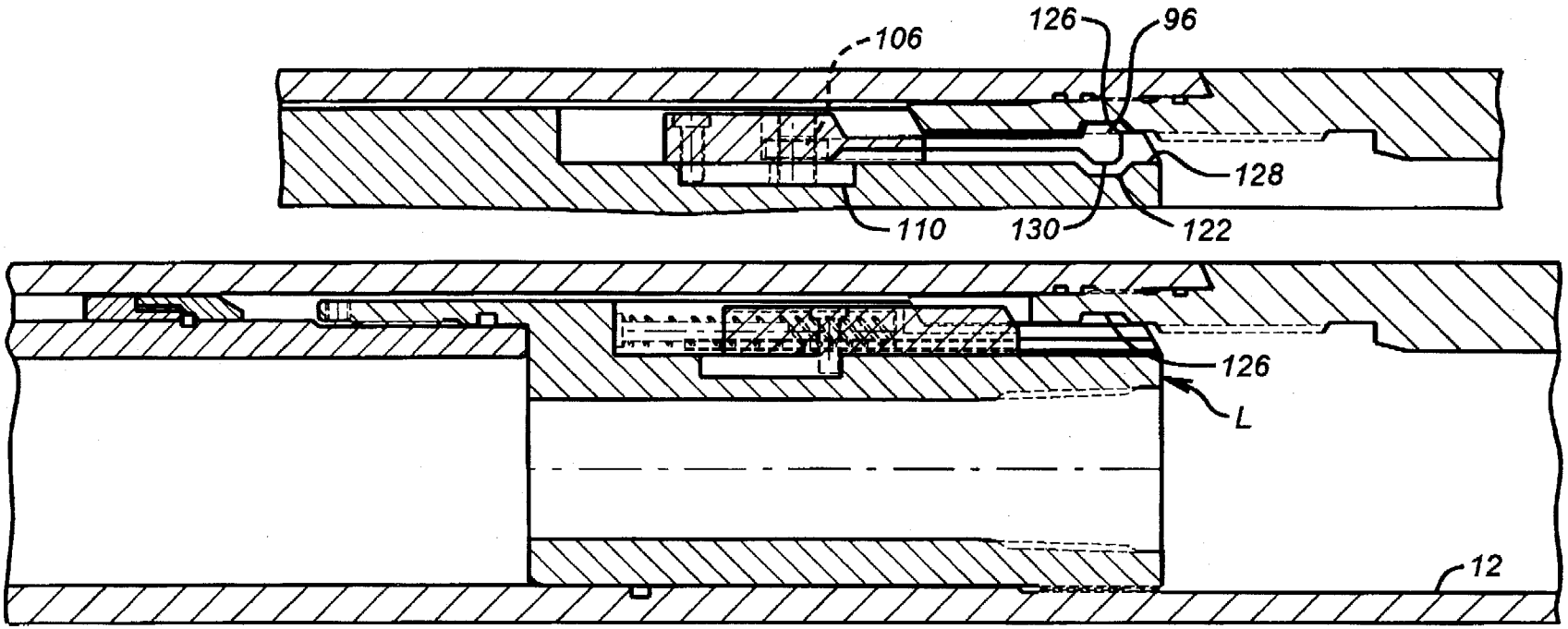
FIG. 6 is the view of FIG. 5, with the collet in the position just short of latching.
Figure 7:
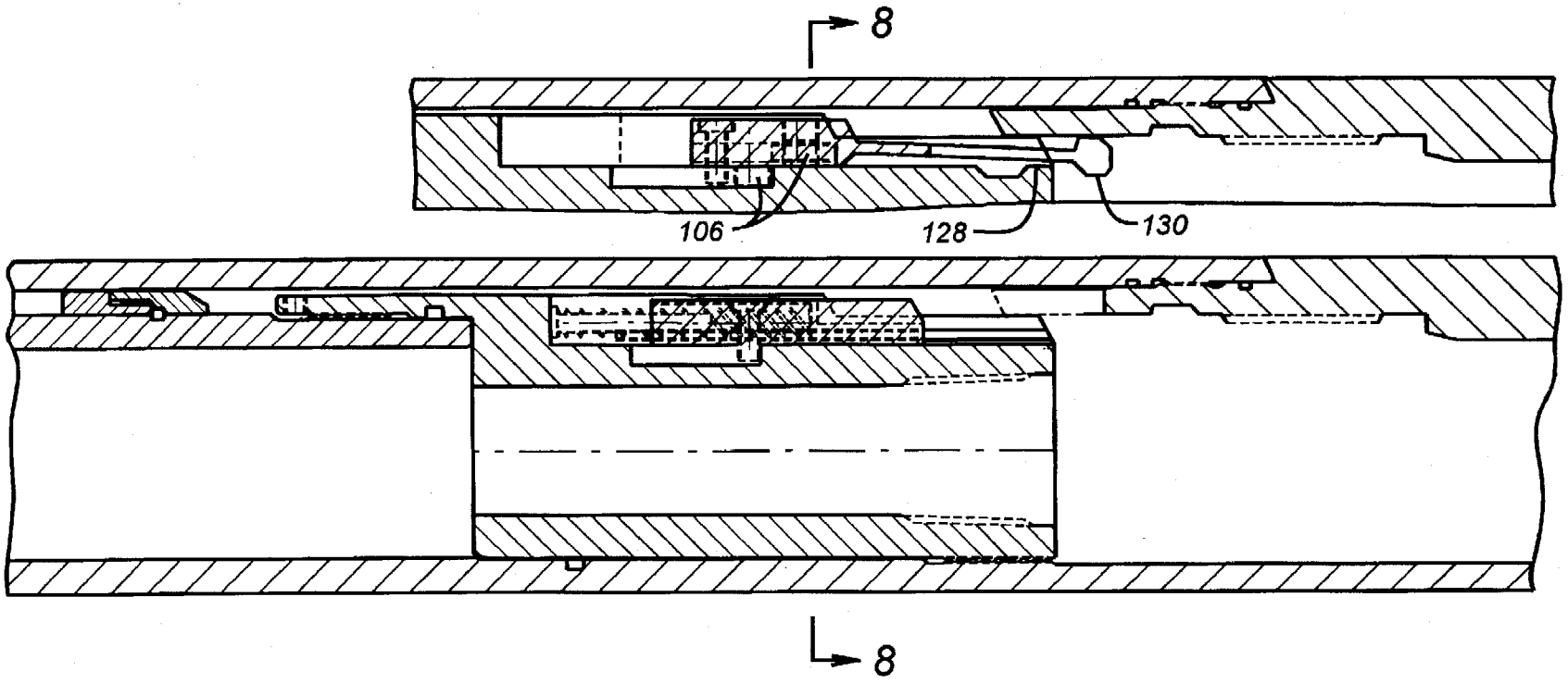
FIG. 7 is the view of FIG. 6, with the shear pin broken and the collet released.
Figure 8:
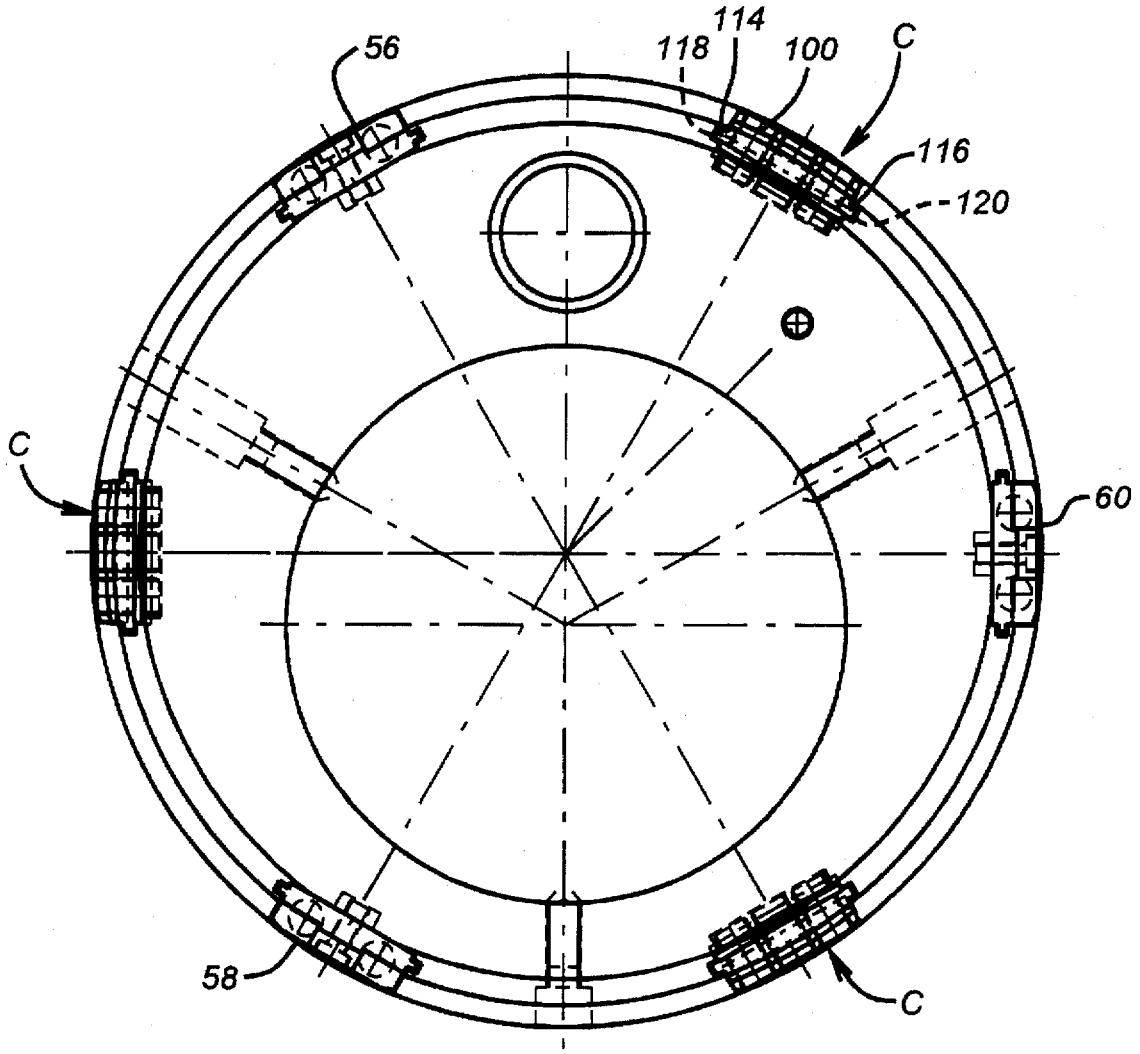
FIG. 8 is the view taken along lines 8—8 of FIG. 7.

Referring now to FIGS. 4–8, an alternative embodiment is presented which includes the features described above, as well as the signaling feature to the surface which comprises of a collet mechanism. The collet mechanism C is shown in FIG. 4 physically above; however, the true orientation is clearly shown in FIG. 8. FIGS. 4–7 show the collet mechanism C in alignment with the torque fingers 56–60 for clarity. Referring now to FIG. 8, the true positioning of the collet mechanism C is illustrated. In the preferred embodiment, three individual mechanisms C are offset from each other at about 120°. The collets are further offset from the torque fingers 56, 58 and 60.

The added feature of the collet mechanism C will now be described. A collet head 96 is attached to a stem 98, which is in turn attached to a base 100. Base 100 has two transverse openings, 102 and 104. A shear pin 106 is located in opening 104. A bolt 108 is located in opening 102. Both the shear pin 106 and the bolt 108 extend into longitudinal slot 110. The position shown in FIG. 4 has the bolt 108 backed up against the end of slot 110. This occurs because the collet head 96 initially bumps inclined shoulder 112.

Each of the bases 100 has a pair of opposed lugs 114 and 116 (see FIG. 8). The lugs 114 and 116 are guided by longitudinal grooves 118 and 120.

Figure 5:
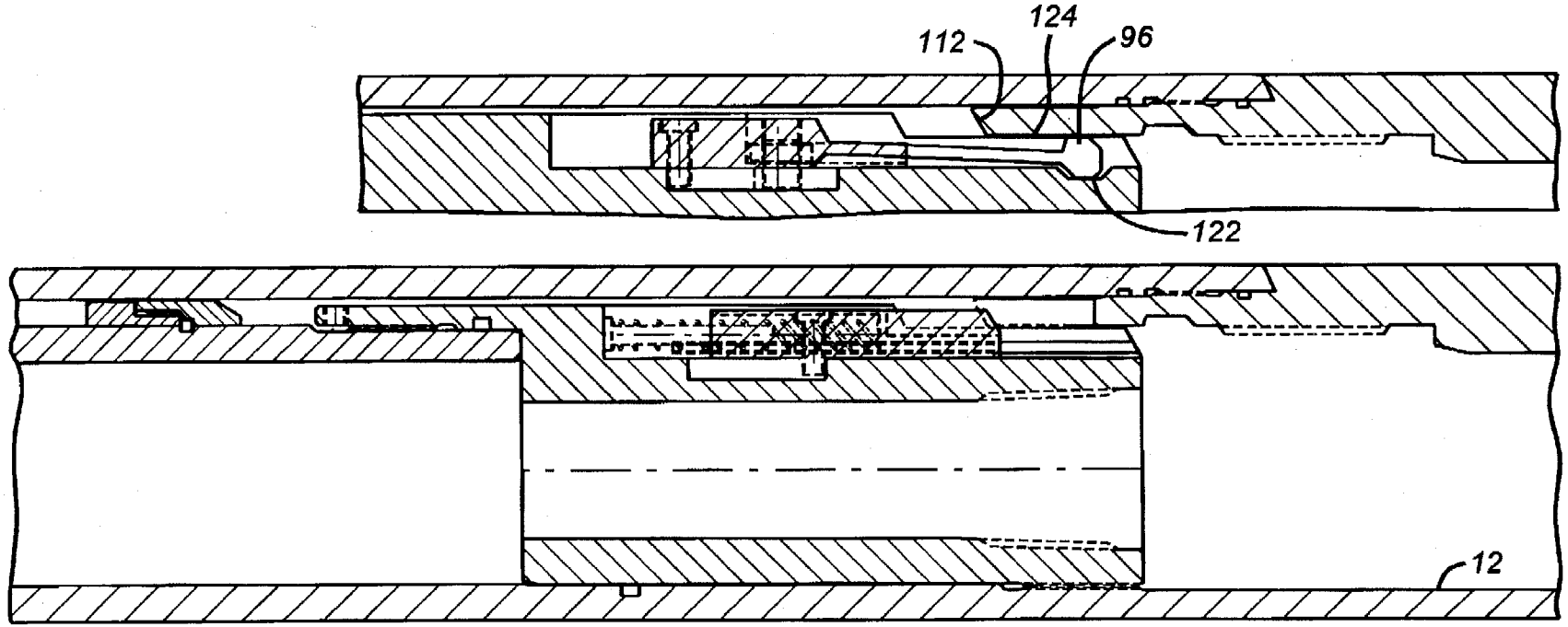
FIG. 5 is the view of FIG. 4, with the collet entering the bore position.

As shown in FIG. 4, the location position involves the collet heads initially contacting the inclined shoulder 112 and being displaced until the bolt 108 comes to the end of the longitudinal slot 110, as shown in FIG. 4. At that time, the collet head 96 is opposite a depressed surface 122. This allows the collet head 96 to be deflected radially inwardly off of inclined shoulder 112, whereupon further advancement of the discharge line 12, as shown in FIG. 5, results in the collet head 96 moving toward depressed surface 122 as it clears the inclined shoulder 112. After clearing the inclined shoulder 112, the collet head 96 rides along annular surface 124. Adjacent annular surface 124 is a depressed surface 126, as shown in FIG. 6. Ultimately, the depressed surfaces 122 and 126 come into alignment, with the collet head 96 in between. At this point, the discharge line 12 is picked up, which places surface 128 in contact with surface 130 of the collet head 96, in effect trapping the collet head 96 into depressed surface 126. After the surface 128 encounters surface 130, the assembly of the discharge line 12 with the locator L attached to it can move up until the end of slot 110 encounters the shear pin 106. At this time, personnel at the surface will know that the locator L has properly reached a location where the torque fingers 56–60 are adjacent or in the slots 52, as shown for example, in FIG. 6, and the seals 86 and 88 are in polished bore 50. Upon receiving the appropriate signal at the surface, a sufficient force is put on the discharge line 12 in an uphole direction to break the shear pin 106, as shown in FIG. 7. Once the shear pin 106 breaks, the discharge line 12 can keep moving upwardly, which allows surface 128 to move beyond surface 130, as shown in FIG. 7. At this time, the grip of the collet head or heads 96 is released, and weight can be set down on the production string until resistance is felt. At that time, the surface personnel attempt to rotate the discharge line 12. If the torque fingers 56–60 are within the longitudinal slots 52, a resistance to rotation is felt at the surface and the surface personnel know that the antirotation feature is in effect, which necessarily implies that the seals 86 and 88 are also in position against the polished bore 50. At this time, the downhole pump can be started, with power from the electric line (not shown), and production to the surface can commence. With the torque fingers 56-60 engaged in the slots 52, the torque reaction from the pump P is absorbed into the top of the liner 46. Also at this time, the chevron seals 86 and 88 effectively seal off the annular space in the well around the discharge line 12. Also assisting in this effort are seals 84 and 44. Seal 84 is an internal seal on the locator L adjacent sleeve 80, while seal 44 seals between the locator L and the discharge line 12. As previously stated, the locator L is locked rotationally to the discharge line 12 through the extension of pin or pins 32 into groove or grooves 34 on discharge line 12.

Those skilled in the art can appreciate that the apparatus as described above is simple to use and employs the polished bore 50 along with the longitudinal slots 52 already present in the top of a typical liner 46 which is in the wellbore. In conjunction with using the pre-existing features of the top of the liner 46, the assembly, which includes the pump P and the discharge line 12, can be readily installed in the top of the liner with high confidence that the installation will result in a seal against the polished bore 50, coupled with an antirotation feature. During operations, sufficient weight is set down on the production string including the discharge line 12 to ensure that the torque fingers 56–60 stay within the slots 52. The entire assembly is easy to build and run into the well and permits easy installation and removal of the production tubing, if necessary. There are few moving parts. The torque fingers 56–60 are spring-loaded via spring 70 so as to not have to rely on the weight of each of the fingers 56–60 as the only force available to make them move down positively into their corresponding longitudinal slots 52. It should be noted that spring biasing is not a feature included with the collet mechanism C.

While the entire collet mechanism C is an optional feature, its addition does not lend undue complication to the apparatus. Just as with the torque fingers 56–60, there is a simple longitudinal guiding system comprising of combinations of lugs sliding in grooves, such as lugs 114 and 116 sliding in grooves 118 and 120. Thereafter, a simple system of longitudinal travel stops, in the form of a bolt 108 and a shear pin 106, completes the collet mechanism C, which latches simply upon a setdown force followed by a pick-up force on the discharge line 12. The shear force required to break the pin 106 can be predetermined to be of a significantly large enough size so as to create a visible signal on the surface instrumentation to alert the surface personnel that the discharge line 12, with its locator L, has properly approached and entered the polished bore 50. Thereafter, a simple test of rotation confirms the fact that the assembly is in position for the pump P to start with the antirotation feature operable.

In the preferred embodiment, the top of the liner 48 is a setting sleeve from an RH-type or HR-type Baker Hughes liner.

The discharge line 12 is axially offset (see FIGS. 2 and 3) in order to accommodate the longitudinal passages 14 and 18 for the electric line, as well as the injection bore 20 along with its aligned threaded bore 22. This offset nature of the discharge line 12 can be seen by looking at FIGS. 2 and 3.

The foregoing disclosure and description of the invention are illustrative and explanatory thereof, and various changes in the size, shape and materials, as well as in the details of the illustrated construction, may be made without departing from the spirit of the invention.

We claim:

1. An apparatus for use with downhole liners having a seal bore and at least one longitudinal slot, comprising:

a tubular segment;

a locator mounted externally to said tubular segment, further comprising:

a seal selectively engageable with the seal bore upon advancement of said tubular segment;

a lock mechanism engageable by substantially longitudinal movement to the longitudinal slot for selectively securing said tubular against rotational loads imposed on said tubular segment downhole.

2. The apparatus of claim 1, wherein said lock mechanism further comprises at least one torque finger movable longitudinally for entry into the slot.

3. The apparatus of claim 2, wherein said torque finger is spring-biased toward the slot.

4. An apparatus for use with downhole linen having a seal bore and at least one longitudinal slot, comprising:

a tubular segment;

a locator mounted externally to said tubular segment, further comprising:

a seal selectively engageable with the seal bore upon advancement of said tubular segment;

a lock mechanism engageable to the longitudinal slot for selectively securing said tubular against rotational loads imposed on said tubular segment downhole;

said lock mechanism further comprises at least one torque finger movable longitudinally for entry into the slot;

said torque finger is spring-biased toward the slot;

said torque finger further comprises at least one longitudinal lug; and said locator formed having a corresponding groove to accept said lug to guide the longitudinal movement of said torque finger.

5. The apparatus of claim 4, wherein:

said locator is formed having a longitudinal slot aligned with said torque finger;

said torque finger comprises a transverse member extending therethrough and into said slot in said locator to retain said torque finger in a slidable relation to said locator.

6. The apparatus of claim 5, wherein said seal further comprises opposed stacks of chevron seals.

7. The apparatus of claim 6, further comprising:

a signal mechanism mounted to said locator to selectively engage the liner subsequent to entry of said seal into the seal bore, said signal mechanism resisting up to a predetermined force before release to provide a surface signal that said seal is in the seal bore.

8. The apparatus of claim 7, wherein said signal mechanism further comprises at least one collet selectively engageable with the liner;

a shear pin to allow release from the liner after an upward pull from the surface exceeding a predetermined value.

9. The apparatus of claim 8, further comprising:

a guide lug on said collet riding in a guide groove in said locator;

a guide pin extending transversely through a portion of said collet and into a longitudinal groove on said locator to limit slidable movement of said collet while still retained to said locator.

10. The apparatus of claim 5, wherein:

said tubular segment is mounted eccentrically in said locator which circumscribes it;

said locator further comprises at least one longitudinal opening therethrough to facilitate passage of an electric line therethrough or for connecting injection tubing.

11. The apparatus of claim 10, further comprising:

a downhole pump connected at the lower end of said tubular segment;

a support sleeve mounted to said locator, said seal supported by said sleeve for contact with the seal bore;

said support sleeve having a cap thereon with at least one longitudinal opening aligned with said longitudinal opening in said locator.

12. An apparatus for use with downhole linen having a seal bore and at least one longitudinal slot, comprising:

a tubular segment;

a locator mounted externally to said tubular segment, further comprising:

a seal selectively engageable with the seal bore upon advancement of said tubular segment;

a lock mechanism engageable to the longitudinal slot for selectively securing said tubular against rotational loads imposed on said tubular segment downhole; and a signal mechanism mounted to said locator to selectively engage the liner subsequent to entry of said seal into the seal bore, said signal mechanism resisting up to a predetermined force before release to provide a surface signal that said seal is in the seal bore.

13. The apparatus of claim 12, wherein said signal mechanism further comprises at least one collet selectively engageable with the liner;

a shear pin to allow release from the liner after an upward pull from the surface exceeding a predetermined value.

14. The apparatus of claim 13, further comprising:

a guide lug on said collet riding in a guide groove in said locator;

a guide pin extending transversely through a portion of said collet and into a longitudinal groove on said locator to limit slidable movement of said collet while still retained to said locator.

15. An apparatus for use with downhole liners having a seal bore and at least one longitudinal slot, comprising:

a tubular segment;

a locator mounted externally to said tubular segment, further comprising:

a seal selectively engageable with the seal bore upon advancement of said tubular segment;

a lock mechanism engageable to the longitudinal slot for selectively securing said tubular against rotational loads imposed on said tubular segment downhole;

said lock mechanism further comprises at least one torque finger movable longitudinally for entry into the slot;

a signal mechanism mounted to said locator to selectively engage the liner subsequent to entry of said seal into the seal bore, said signal mechanism resisting up to a predetermined force before release to provide a surface signal that said seal is in the seal bore;

said signal mechanism further comprises at least one collet selectively engageable with the liner, and a shear pin to allow release from the liner after an upward pull from the surface exceeding a predetermined value.

16. The apparatus of claim 15, further comprising:

a plurality of torque fingers on said locator;

a plurality of collets on said locator, each of which is offset from a pair of said torque fingers.

17. The apparatus of claim 16, wherein:

said torque fingers are spaced at about 120° apart from each other;

said collets are spaced about 120° from each other.

* * * * *